United States Patent [19]

Holliday

[11] 4,361,321

[45] * Nov. 30, 1982

[54] REMOVABLE BIN SYSTEM IN A COLLATOR

[76] Inventor: David H. Holliday, 15521-15th Ave. NE., Seattle, Wash. 98155

[ * ] Notice: The portion of the term of this patent subsequent to Jul. 3, 1996, has been disclaimed.

[21] Appl. No.: 963,972

[22] Filed: Nov. 27, 1978

Related U.S. Application Data

[62] Division of Ser. No. 841,113, Oct. 11, 1977, Pat. No. 4,159,825.

[51] Int. Cl.[3] ..... B65H 39/10

[52] U.S. Cl. ..... 271/292

[58] Field of Search ..... 271/173, 292, 294; 214/610, 8; 270/58; 414/331

[56] References Cited

U.S. PATENT DOCUMENTS

| | | | |
|---|---|---|---|
| 3,497,207 | 2/1970 | Caldwell | 271/64 |
| 3,740,050 | 6/1973 | Jacobs | 271/173 |
| 3,938,801 | 2/1976 | Holliday | 271/173 |

*Primary Examiner*—Richard A. Schacher
*Attorney, Agent, or Firm*—Thomas W. Secrest

[57] ABSTRACT

This invention is directed to a collator and, in particular, a removable bin system in the collator. The purpose of this removable bin system is to make it possible to more, fully, utilize the printer and the collator. Prior to this invention, the printer and the collator could not operate after the collator bins had received the printed material. It was necessary to empty the collator bins before using the printer and the collator for another run of material. With this invention it is possible to more, fully, utilize the printer and the collator for printing and sorting the printed material.

1 Claim, 12 Drawing Figures

REMOVABLE BIN SYSTEM IN A COLLATOR

There are co-pending patent applications identified as follows: A FEEDING MECHANISM FOR A COLLATOR, Ser. No. 855,273, and filing date of Nov. 28, 1977; and, A COLLATOR, Ser. No. 894,688, and filing date of Apr. 10, 1978. There are co-pending patent applications with RONALD W. GREENE as co-inventor and identified as: PAPER SHEET MECHANISM FOR A CONTINUOUS SORTING MACHING, Ser. No. 897,275, filing date of Apr. 17, 1978; and two co-pending patent applications with RONALD W. GREENE and ANTHONY C. CLARKSON as co-inventors, BIN RECEIVER MECHANISM FOR A CONTINUOUS PAPER SORTING MACHINE, Ser. No. 897,273, filing date of Apr. 17, 1978; CONTINUOUS PAPER SORTING MACHINE, Ser. No. 897,272, filing date of Apr. 17, 1978; and, a div. of parent application Ser. No. 841,113, filing date of Oct. 11, 1977 now U.S. Pat. No. 4,159,825 in the name of DAVID H. HOLLIDAY and entitled REMOVABLE BIN SYSTEM IN A COLLATOR.

GENERAL BACKGROUND OF THE INVENTION

In many places there are reproduction centers or inplant reproduction centers. For example, in industry there are inplant reproduction centers. In commercial houses there are inplant reproduction centers. Also, in various government agencies there are inplant reproduction centers. These reproduction centers may produce cataloges, maintenance manuals for equipment, instruction books for operating equipment, brochures, sales material and specifications for bidders to use in making a bid. These are only a few of the uses to which a reproduction centers may be used.

In a reproduction center there is used a printing machine such as an offset duplicator or copier. The printed material from the offset duplicator must be collated so as to be made into the catalog, manual, instruction book and the like. It is possible to collate the printed material by hand. However, the cost of collating material manually is expensive and therefore self-defeating. As a result, at the present time, very few places use manual labor to collate the printed material.

In the last few years, in order to lessen the manual labor in the collation process and in order to lessen the cost and also to lessen the time required for collating, there has been developed apparatus to assist in the collating of the printed material. This apparatus or collator has taken the form of a series of vertical bins. Each bin receives a copy of the printed material. There is a feeding apparatus for feeding the printed material to the bins. From experience, the number of vertical bins in a vertical column has been established as fifty-two bins.

The feeding apparatus in feeding the printed material or printed sheet to a column of bins will feed the necessary sheets to one column of bins and then the column of bins in the feeding apparatus will move with respect to each other. In this time that the column of bins and the feeding apparatus move with respect to each other, the offset duplicator or printing apparatus is not operating. As a result, the image thickens and there becomes excess ink on the printing plate. The excess ink, upon being printed upon the next sheet of paper, appears messy and sloppy. In order to remove the excess ink from the printing plate, it is necessary to run a number of printed sheets such as say, ten printed sheets. This means that ten printed sheets have been wasted in order to clean the printing plate. This can be translated into a waste of time as well as a waste of paper. The press speed of many duplicators is nine thousand sheets per hour which means one hundred fifty sheets per minute or two and one-half sheets per second. With a collator having fifty-two bins in a vertical column, there is required approximately three to four seconds to move the bins and the feeding apparatus with respect to each other. Then, to start the offset duplicator printing, again, there is required another three-to-four seconds. Then to clean the printing plate, there is required about ten copies of printed material or about four seconds. It is seen that this process of stopping the printing apparatus, moving the feeding apparatus and the vertical bins with respect to each other and then starting the printing apparatus again, requires from ten to twelve seconds. To print the material to go into fifty-two bins requires approximately twenty seconds. In other words, the printing apparatus, the feeding apparatus, and the collating apparatus are wasting about one-half of the time required to print the printed page.

If the collating apparatus can function for all copies of a printed sheet continuously, then there is a saving of approximately one-third of the time as it is not necessary to stop the printing apparatus after a column of bins has received an alloted number of copies. The reader is reminded that with the stopping of the printing it is necessary to waste about ten printed sheets. The printed pages can be printed continuously and collated into the bins.

It is my understanding that, at the present time, when a catalog or a maintenance manual or an instruction book or other multiple copies and pages are printed and collated the national average of copies is about 175 copies. As there are 52 bins in a vertical column of bins, this means that there must be three or more vertical columns of bins or one hundred four bins. A large bank of bins will have 624 bins. Again, to repeat, from the above calculation, if there is used a continuous operating collator there is saved about one-third of the time required in printing the printed sheet and in collating the printed sheet. A saving of one-third in time is a large percentage of saving or a large saving in time.

After the printed copies have been inserted into the bins, it is necessary to remove these printed copies from the bins. As an example, assume that the catalog is to have 10 sheets and that there are 175 copies of these ten sheets. In order to remove the ten sheets from each of the 65 bins, it is necessary to stop the printing apparatus and it is also necessary to stop the feed tower. Then, an individual can handpick ten copies from each of the 175 bins. An individual requires, approximately, fifteen minutes to handpick the ten copies each from the 175 bins. This means that the printing apparatus and the collating apparatus are not functioning. There is a waste of time and a waste of the investment in the printing apparatus and the collating apparatus.

With a larger bin system, such as 208 bins, the time required to remove the copies from the 208 bins is about fifteen minutes. In other words, the larger the capacity of the collator or the larger the number of bins, the greater the amount of time the printing apparatus and the collating apparatus are not functioning.

The subject invention is directed to lessening the amount of time the printing apparatus and the collating apparatus are not being used while removing the printed copies from the bins.

THE GENERAL DESCRIPTION OF THE INVENTION

In this invention there is provision for removing the filled set of bins or bin section from the collator and inserting a second set of empty bins in a second bin section frame into the collator. For illustrative purposes, and in the above example, it was assumed that there were ten sheets of printed material and 175 bins. With this invention it is possible to remove the bin section frame from the collator, in this instance 208 bins, and to place the bin section frame with the printed material to one side. Then, a set of empty bins in a bin section frame can be inserted into the collator. The time required for removing the first set of full bins from the collator and for positioning a second set of emtpy bins into the collator is about one minute. The printing apparatus and the collating apparatus can be started and can be running while an individual is handpicking the printed material from the 175 bins. With this invention the printing or copying apparatus and the collator are out of use for about one minute instead of the printing apparatus and the collator being out of use for fifteen minutes with the handpicking system apparatus. Actually, with this invention, the printing apparatus and the collator are not out of use fifteen minutes but are out of use approximately one minute. When an individual has removed the first set of full bins from the collator and inserted the second set of empty bins into the collator, the duplicator or copier can resume production of printed material. The result is that the printing or copying apparatus and the collator are again in production while the set of filled bins, which has been removed from the collator base, is being emptied. It is seen that after a person has handpicked the printed material from the bins which are not in the collator these bins are now empty and ready to be inserted into the collator for receiving additional printed material.

With a larger collator having a bin capacity of 208 bins, the saving is about fourteen minutes. The average number of times the 208 bin collator is filled and emptied in an eight hour working day is five times. With a saving of fourteen minutes for each time the bins are emptied, there is a savings of about seventy minutes daily. The saving of seventy minutes means that the printing/copier apparatus and collating apparatus can be in effective operation about one more hour in an eight hour shift.

THE OBJECTS AND THE ADVANTAGES

An object of this invention is to provide an apparatus and a method to increase the effective production time in a printing center and to increase the effective utilization of printing apparatus and collating apparatus in a printing center; an additional object is to provide such an apparatus which is inexpensive to manufacture and can be, readily, used by the employees in a printing center; and, requires only a small amount of time to change collator bin sets so as to remove the full collator bin set from the collator and insert an empty collator bin set into the collator for receiving sheets of printed material, thereby decreasing downtime of the printing apparatus and collating apparatus and increasing the production and profit of the apparatus.

These and other objects and advantages will be more particularly brought forth upon reference to the specific description of the invention, the appended claims and the accompanying drawings.

THE DRAWINGS

Figure 7:
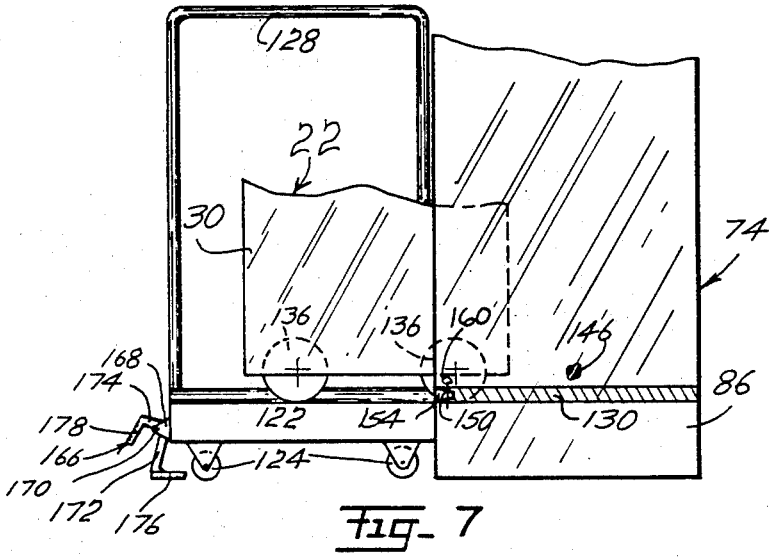
Figure 8:
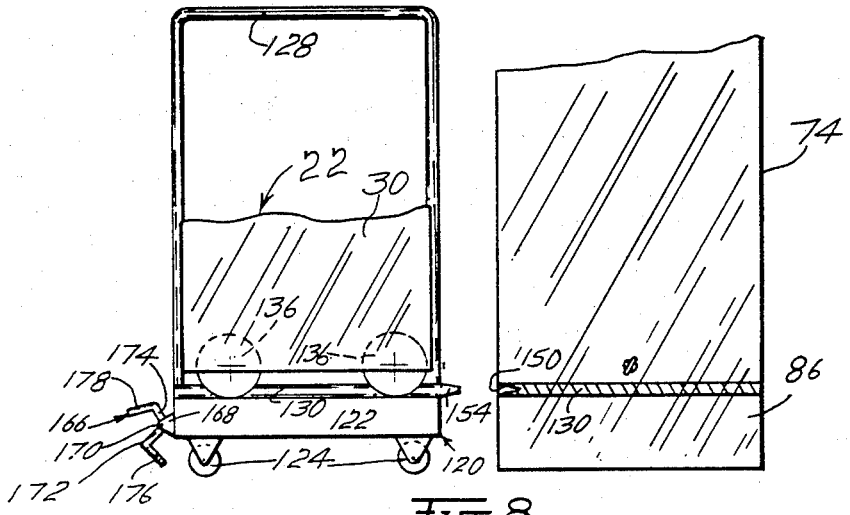
Figure 9:
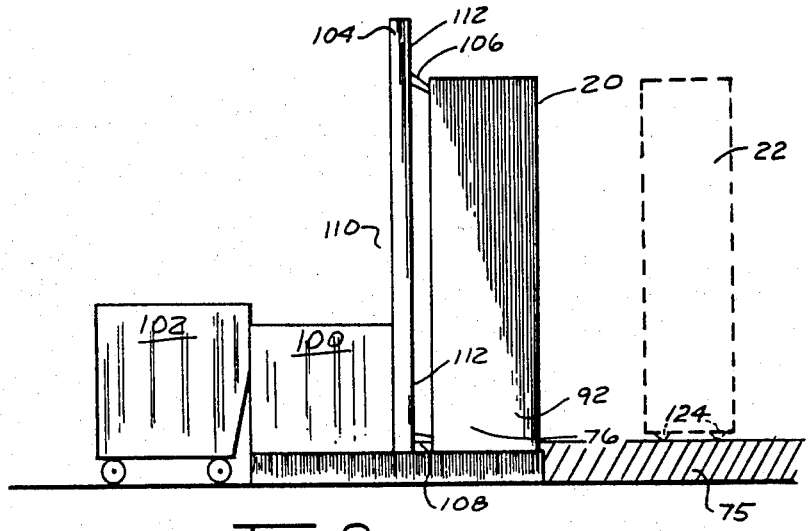
Figure 10:
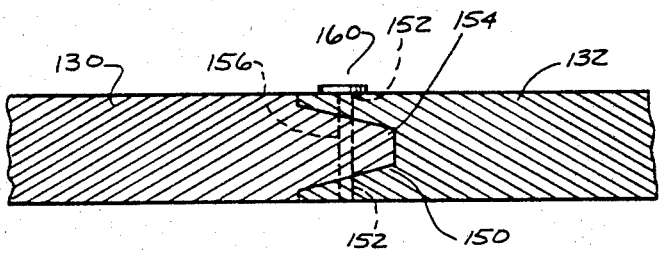
Figure 11:
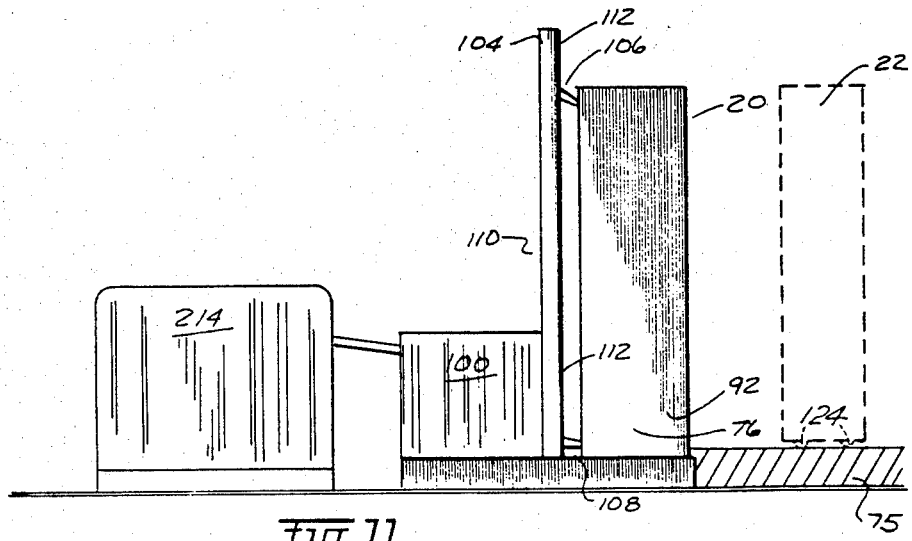

FIG. 7 is a side-elevational view illustrating the bin section frame of the collator partially in position on the collator and partially on the dolly so that it is possible to say that the bin section frame is being transferred from the collator to the dolly or that the bin section frame is being transferred from the dolly to the collator, and also illustrating a registering means for aligning the dolly and the collator to assist in transferring the bin section frame from one to the other;

FIG. 8 is a side-elevational view illustrating the bin section frame on the dolly and the dolly close to the collator;

FIG. 9 is a side elevational view of the collator, the feed table and the off-line feeder;

FIG. 10 is a fragmentary view of the lock for the registering means between the dolly and the collator; and, FIG. 11 is a side elevational view of the collator, the feed table and the duplicator.

Figure 12:
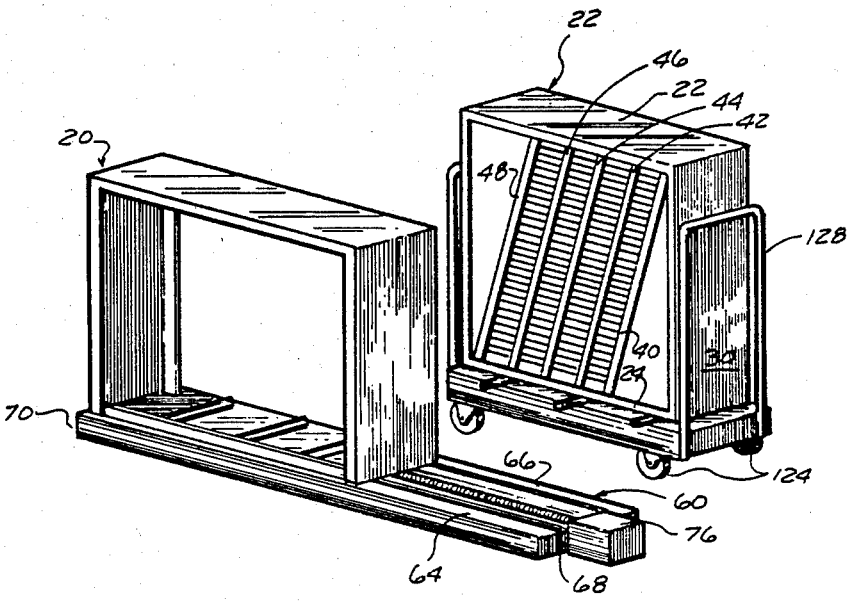

FIG. 12 is a perspective view illustrating the collator without the bin section frame and a dolly with a bin section frame.

THE SPECIFIC DESCRIPTION OF THE INVENTION

Figure 1:
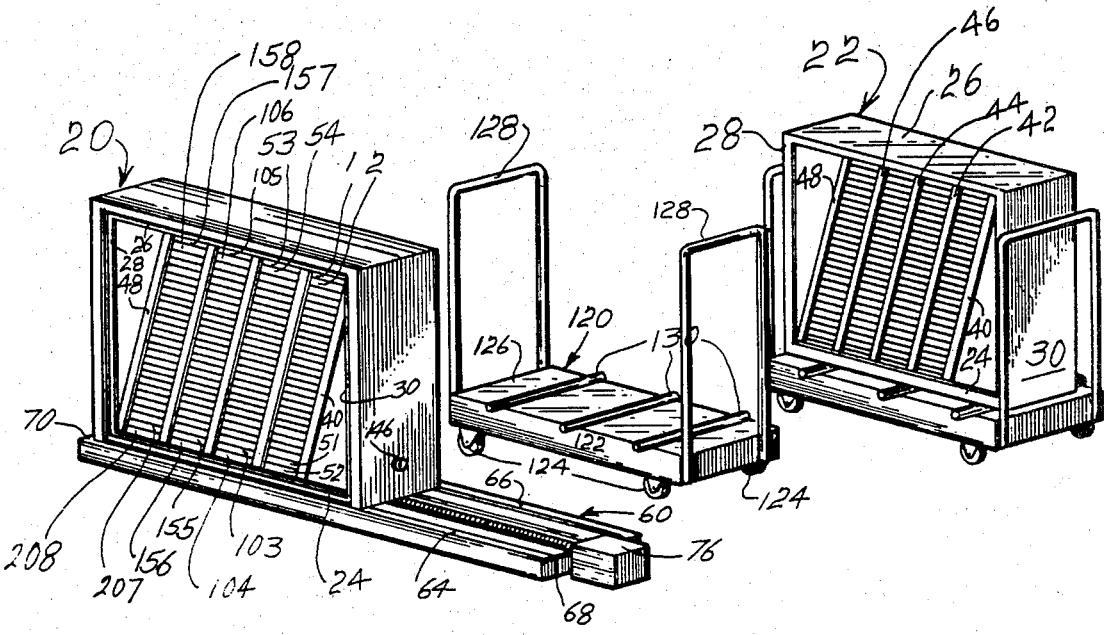
FIG. 1 is a perspective view illustrating the collator, an empty dolly for receiving a bin section frame from the collator and a dolly with a bin section frame for insertion into the collator.
Figure 4:
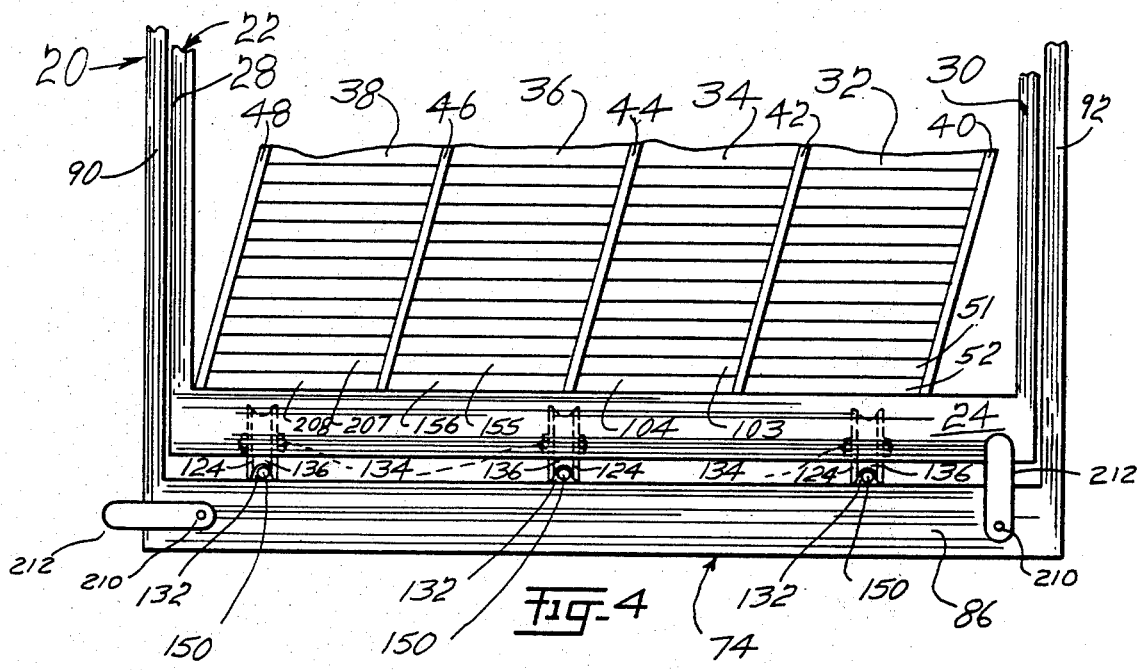
FIG. 4 is a front-elevational view illustrating the collator, the frame of the collator and the bin section frame in said frame of the collator.

In FIGS. 1 and 4 there is illustrated a collator 20. The collator 20 comprises a bin section frame 22 having a bottom support and guide rail 24 and a top rail 26. The bottom rail 24 and the top rail 26 are connected by stiles 28 and 30 to form the upright integral bin section frame 22.

In the bin section frame 22 are four columns of bins; a first column of bins 32; a second column of bins 34; a third column of bins 36; and a fourth column of bins 38. On each side of the first column of bins 32 are support members, a first support member 40 and a second support member 42. The second column of bins 34 is positioned between the second support member 42 and the third support member 44. The third column of bins 36 is positioned between the third support member 44 and the fourth support member 46. The fourth column of bins 38 is positioned between the fourth support member 46 and the fifth support member 48. It is seen in FIGS. 1 and 4 that support members 40, 42, 44, 46 and 48 run at an angle or are diagonally spaced with respect to the bin section frame 22 and that these support members are parallel to each other. The frame 22 connects with the support members 40, 42, 44, 46 and 48 and the columns, 32, 34, 36 and 38, of bins.

As previously stated, the standard collator has fifty-two bins in a column. In FIGS. 1 and 4 there are fifty-two bins in the first column and the top bin will be identified by reference numeral 1 and the next bin will be identified by reference numeral 2 and the bottom bin will be identified by reference numeral 52 and the next to the bottom bin will be identified by reference numeral 51. It is to be realized that between bins 2 and 51 in the first column there are 48 bins. In column 2 the top bin will be identified by reference numeral 53 and the next to the top bin will be identified by reference numeral 54. Also, in the second column the bottom bin will be identified by the reference numeral 104 and the next to the bottom bin in column 2 will be identified by reference numeral 103. It is to be realized that in the second column between bin 54 and bin 103 there are forty-eight receiving bins for sheets of material or printed material.

Likewise, in columns 3 and 4 there are 52 bins with the top bin in column 3 bearing reference numeral 105 and the next to the top bin bearing reference numeral 106 and the bottom bin in column 3 bearing reference numeral 156 and the next to the bottom bin bearing reference numeral 155. In the third column between bins 106 and 155 there are 48 bins. In the fourth column the top bin will bear reference numeral 157 and the next to the top bin will bear reference numeral 158 with the bottom bin bearing numeral 208 and the next to the bottom bin bearing reference numeral 207. In the fourth column between bin 158 and bin 207 there are forty-eight bins.

In a column of bins and, for example, column 32, it is seen that bins 1 and 2 are spaced apart an incremental distance or an increment of a predetermined distance so that bin number 1 does not completely overlie bin number 2 even though the bins in the columns are, substantially, vertically positioned and that bin number 51 does not completely overlie bin number 2 even though the bins in the columns are, substantially, vertically positioned. The adjacent bins in a column are offset from each other a short distance such as about one-quarter of an inch to one-half an inch. Or, in other words, bins 1 and 2 are offset from each other about one-quarter of an inch or one-half inch, and, likewise, bins 51 and 52 are offset from each other about one-quarter of an inch or one-half inch. It is seen that an upper bin, partially overlies the next lower bin and partially extends over the next lower bin. In columns 1 and 2 the uppermost bin 53 in column 2, substantially, overlies the next to the lower bin 51 in column 1, and the next to the upper bin 54 in column 2, substantially, overlies the lowermost bin 52 in column 1, see FIG. 1. With this arrangement of the bins, it is possible to introduce, substantially, simultaneously, sheets of material or printed pages into bins 53 and 51 and likewise to introduce substantially, simultaneously, sheets of material or printed pages into the bins 54 and 52 so as to, continuously, feed the printed pages to the collator 20 without having to stop the feeding mechanism to introduce sheets of material or printed pages into bins in adjacent columns. The feeding mechanism and the collator operate, continuously, for all copies of a printed sheet.

In FIGS. 1 and 4 it is seen that there is a support frame 60 having two spaced-apart sides 64 and 66 and two spaced-apart ends 68 and 70. The support frame 60 is integral. The support frame 60 supports the bin section frame 22 and also acts as a guide for the rectilinear movement of the collator frame 74 and bin section frame 22 in the support frame 60.

At one end of the support frame 60, and outside of the end 68, there is a control and motor unit 76. The control and motor unit 76 connects with and drives a screw shaft 78.

Near the end 68 and inside the support frame 60 there is a bearing 80 and near the other end 70 there is a bearing 82 for the screw shaft 78.

The collator frame 74 comprises a bottom rail 86, a top rail 88, a left stile 90 and a right stile 92. An illustration of the collator frame 74 is in FIGS. 1 and 4.

There is attached to the bottom rail or guide rail 86 and the collator frame 74 a lug 96 having a tapped center passageway 98. The screw shaft 78 passes through the tapped center passageway 98. The screw shaft 78 on rotating moves the collator frame 74 in a rectilinear path in the support frame 60.

Figure 2:
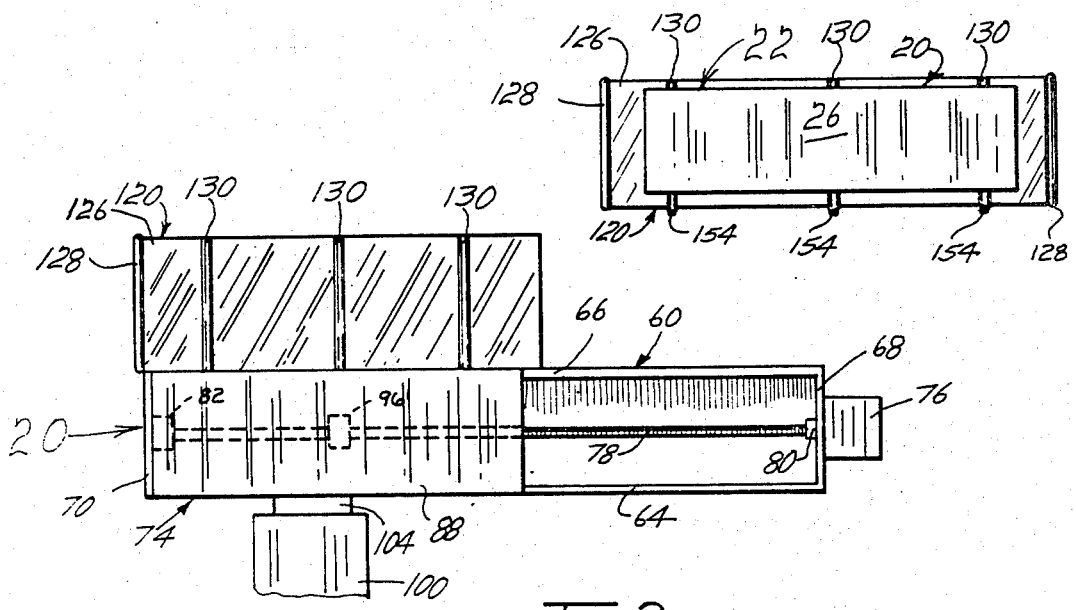
FIG. 2 is a plan view illustrating the collator, the feed tower, an empty dolly for receiving a bin section frame from the collator and a dolly with a bin section frame for insertion into the collator.
Figure 3:
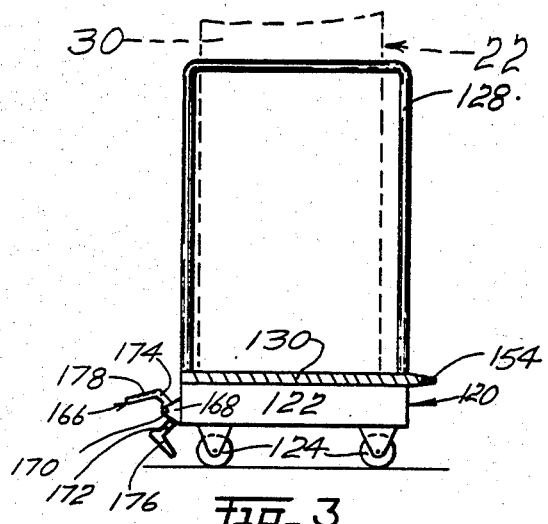
FIG. 3 is a side-elevational view illustrating a dolly with a bin section frame, in phantom, in position on the dolly.

In FIGS. 2 and 9 there is illustrated a feed table 100 and an off-line feeder 102. This off-line feeder 102 is positioned adjacent to the feed table 100 so that the printed sheets of material are readily available to the feed table 100. In FIG. 9 it is seen that the feed table 100 comprises a vertical column 104. The vertical column 104 has three traveling feed paper ejector finges 106, 108 and 110. The paper ejector fingers travel vertically and also move around the ends of the vertical column 104. In FIG. 9 it is seen that the ejector finger 108 is in a position to introduce a sheet of printed material 112 into bin 52 in the first column or column 32 and, substantially, simultaneously, to introduce a sheet of printed material 112 into a bin 53 in the second column 34.

It is to be clearly understood that the feed table 100 and the off-line feeder 102 are commercially available units. In fact, there are a number of manufacturers for the feed table 100 and also for the off-line feeder 102.

A more detailed and complete description of the collator is to be found in my U.S. Pat. No. 3,938,801, issuing date of Feb. 17, 1976, entitled "CONTINUOUS OPERATING COLLATOR", and is incorporated by reference into this patent application.

On the bottom rail 24 of the bin frame 22 there are three spaced-apart shafts 134. These shafts 134 are mounted on the bottom rail 24. There is mounted on each of the shafts 134 a wheel 136. The wheel 136 co-fits with a rail 132. It is seen that the wheel 136 has a groove 138. The groove 138 fits over or co-fits with the rail 132 so as to be guided by said rail 132. By means of the wheels 136 it is possible to roll the bin section frame out of the collator frame 72 onto a platform such as the floor 75, see FIGS. 5, 9 and 11. In these figures it is seen that the bin section frame (in phantom) is positioned on the floor as platform. The floor is a stationary platform and cannot move.

In FIGS. 1, 2, 3, 6, 7, 8 and 10 there is illustrated a dolly 120 having a base 122. From the underneath side of the base 122 are castors or wheels 124. The base 122 has an upper surface 126. At one end of the dolly 120 there is a hand rail 128. Attached to the upper surface 126 are three spaced-apart dolly frame guide rails 130. On the upper surface of the collator frame guide rail 86 are three spaced-apart collator frame guide rails 132. The guide rails 130 on the dolly and the guide rails 132 in the collator frame 74 are aligned so that these two sets of guide rails can register with each other. By means of the wheels 136 it is possible to roll the bin section frame 22 out of the collator frame 74 and onto a moveable platform such as a dolly 120 or, conversely, to roll the bin section frame 22 from the dolly 120 into the collator frame 74.

In FIG. 4 it is seen that on the bottom rail 24 there is mounted a nut 140. There is a passageway 144 in the upright stile 92. A bolt 146 may be pushed through the passageway and screwed into the nut 140 to definitely position the bin section frame 22 with respect to the collator frame 74. In this way, the bin section frame 22 and the collator frame 74 can be locked together so that with the movement of the collator frame 74 on the guide 60 the bin section frame 22 will remain in position. Also, in FIG. 4 it is seen that there is a passageway 144 in the stile 90 and that there is another nut 140 in the bottom rail 24. A bolt 148 can be placed in the passageway 144 and screwed into the nut 140 as, previously, explained with respect to the nut and bolt associated with the upright stile 92.

Figure 5:
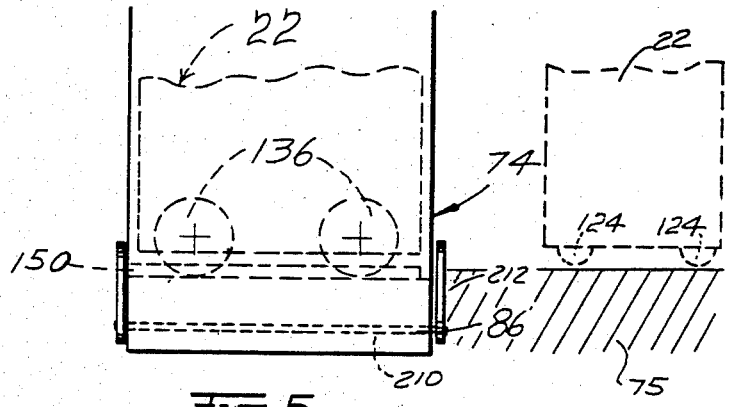
FIG. 5 is a side-elevational view illustrating the bin section frame of the collator positioned in the collator.

In FIG. 5 it is seen that for each guide rail 130 or guide rail 132 that there are two spaced-apart wheels 136. This makes a total of six wheels to support the bin section frame on the lower guide rail 86 of the collator frame 74 or to support the bin section frame 22 on the dolly 120.

In FIGS. 3, 6, 7, 8, and 10, there is illustrated the registering means for registering the dolly frame guide rail 130 with the collator frame guide rail 132.

In the end of the collator frame guide rail 132 there is a recess 150. In the end of the collator frame guide rail 132 there are two aligned passageways 152. On the end of the dolly frame guide rail 130 there is a projection 154 for insertion into the recess 150. In the end of the projection 154 there is a passageway 156. With the projection 154 in the recess 150 the two aligned passageways 152 and the passageway 156 are aligned with each other so that a pin 158 can be dropped into these passageways to lock together the dolly 120 and the collator frame 74. Then, it is possible to move a bin section frame 22 from the collator frame 74 and onto the dolly 120 or to move a bin section frame 22 from the dolly 120 onto the collator frame 74. As an example of the use of this invention assume that there is a collator having 208 bins. It is desired to print 208 copies of a first book having ten pages and to print 150 copies of a second having 20 pages. The first page of the first book is printed so that 208 copies of the first page are continuously printed. Then, a new printing plate can be placed on the printing apparatus and the second page continuously printed. With the conventional collating apparatus, prior to my invention, it was not possible to continuously print 208 copies of a page. There would be printed 52 copies of a page. Then, the collator would be moved and a second set of 52 copies would be printed. In order to print 208 copies of the same page it was necessary to shut down the collator and printing apparatus and feeding apparatus four times and move the collator four times. With my collator, it is possible to print, continuously, 208 copies of the same page. Also, prior to my invention, after the 208 copies of ten sheets each had been printed, the collator, printing apparatus and feeding apparatus would be stopped and a person would hand pick the ten sheets from each of the 208 bins. This would probably take about fifteen minutes. In this fifteen minute interval the expensive printing apparatus, feeding apparatus and collator would not be in productive use. With my invention the bin section frame 22 could be removed from the collator frame 74, see FIGS. 6, 7, and 8, and placed onto the dolly 120. The dolly 120 could be moved away from the collator frame 74 and a new bin section frame 22 introduced into the collator frame 24. The 150 copies of the twenty page book could then be printed and collated while, at the same time, the 208 copies of the ten page book could be removed from the collator. The time required to transfer the bin section frame 22 with the 208 copies of the ten page book from the collator frame to the dolly 120 and to transfer the empty bin section frame 22 to the collator frame 74 for receiving the 150 copies of the twenty page book is, approximately, one minute. As is seen there is a saving in time for the 208 copies of the ten page book of approximately fourteen minutes. As previously stated, with five changes of a bin collator per day there is a saving of approximately seventy minutes ($5 \times 14$) so as to realize, approximately, an additional seventy minutes of productive working time in an eight hour shift.

Figure 6:
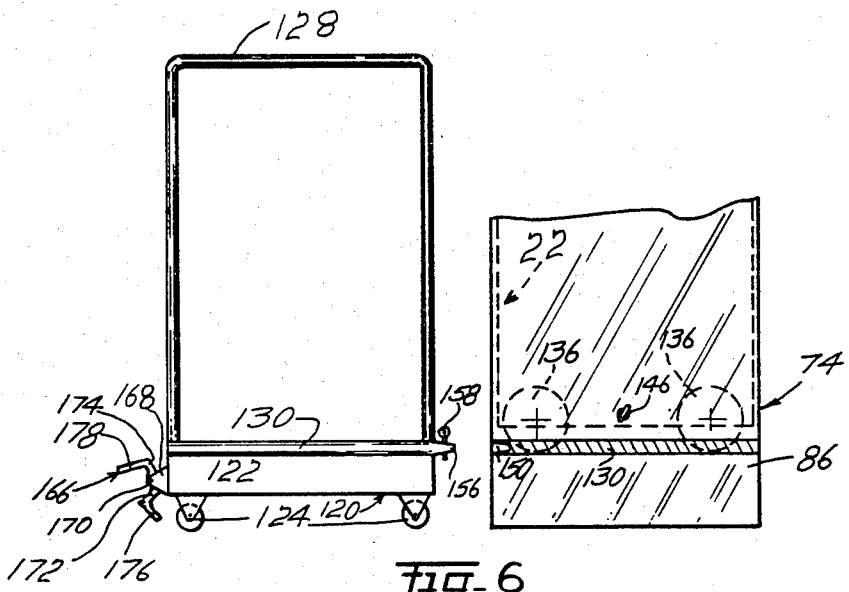
FIG. 6 is a side-elevational view illustrating the bin section frame in position in the collator and a dolly next to the collator for receiving the bin section frame.

To assist in positioning the dolly 120 in a registered position with the collator frame 74 and to hold said dolly in said registered position where there is provided a lock 166. In FIGS. 6, 7, and 8 it is seen that on the side of the base 122 of the dolly 120 there is a bracket 168. In the bracket 168 there is a shaft or pin 170. The lock 166 comprises a first lever arm 172, a second lever arm 174. The pin or shaft 170 connects the bracket 168 at the junction of the first lever arm 172 and the second lever arm 174. It is seen that the lock 166 can rotate around the shaft 170. On the lower end of the first lever arm 172 there is a foot 176. On the outer end of the second lever arm 174 there is a pushing surface 178.

In FIG. 6 it is seen that the dolly 120 is being positioned adjacent to the collator frame 74. In FIG. 7 the projection 154 has been positioned in the recess 150. Also, the pin 162 has been positioned in the aligned passageways 152 and 156. The dolly 120 should be registered with the collator frame 74. In order to add stability to the positioning of the dolly and the collator frame with respect to each other, a person with his foot may press on the pushing surface 178 so as to rotate the lock to have the foot 176 in contact with the floor or ground. In this manner the lock 166 stabilizes and locks the dolly in position near the collator frame 74.

In FIG. 11 there is illustrated a collator 20 and from which collator there has been removed the bin section frame 22. The bin section frame 22 is positioned on the dolly 120. It may be that the bin section frame 22 is being maneuvered into position for insertion into the collator 20 or that the bin section frame 22 has been removed from the collator 20 so that the printed sheets in the bin section frame can be removed and processed into a book or a manual.

There are various modifications of the collator 20 and the bin section frame 22. For example, as an alternative to the bolt 146 and the nut 140 for positioning the bin section frame 22 into the collator 20 there may be used a pin 210 with a rotatable lever or latch 212, see FIG. 4. For example, to position the bin section frame 22 into the collator 20 the lever 212 may be rotated upwardly in a locking position as illustrated in the right part of FIG. 4. To remove the bin section frame 22 from the collator 20 the lever 212 may be rotated, by hand, to a position as illustrated in the left part of FIG. 4. The reader is to understand that the purpose served by the bolt 146 and the nut 140 and also by the lever 212 is to lock the bin section frame in position in the collator 20 so that there is no accidental movement of the bin section frame.

In FIG. 10 there is illustrated the pin 162 in the passageway 152 in the rail 132 and in the passageway 160 in the rail 130. This pin is to lock together the dolly 120 and the collator 20. In certain instances, it will not be necessary to insert the pin 162 as the foot lock or brake 166 will be sufficient to hold the dolly 120 next to and in position with the collator 20.

In FIG. 9 there is illustrated a printer 214 for use in conjunction with the off-line feeder 102 and the feed table 100. In order to have printed pages for collating it is necessary to have a printer 214. The printer 214 may be an inexpensive mimeograph machine or it may be a high-speed copier as used in an office or it may be an inexpensive printer.

In preparing this patent application there has been reference to the applicant's issued U.S. Pat. No. 3,938,801, issuing date of Feb. 17, 1976 wherein there were cited the U.S. Pat. Nos., to Smith, 2,920,888; and, to Jacobs, 3,740,050. The applicant did not make a patent search in the preparation of this patent application. However, the results of another patent search, relating to the handling and processing of paper, were made available to the applicant.

From the foregoing and having presented my invention, what I claim is:

1. A method of collating copies in a collator and bin system characterized by a. a collator having a movable collator frame member thereon adapted to receive the bin section frame hereinafter defined;

b. a bin section and a bin section frame integral therewith, the bin section having at least two columns of bins;

c. guide means on the collator frame member for guiding the bin section frame onto and off the collator frame member;

d. means on said collator for moving the collator frame member, thereby varying the location of the columns of bins therein relative to the collator; and, e. a platform for receiving the bin section frame guided off the collator frame, which comprises continuously feeding copies of each page to the bins, and simultaneously moving copies and columns with respect to each other horizontally and vertically whereby each page is fed one by one, bin by bin into said columns without interruption, page after page until a desired number of pages have been introduced into the bin section and thereafter guiding the bin section frame off the collator frame onto the platform and away from the collator frame, then moving a second like bin section frame onto the collator and thereafter collating copies therein while removing copies from the bins in said first bin section frame.

* * * * *